United States Patent [19]

Tate et al.

[11] Patent Number: 4,995,428

[45] Date of Patent: Feb. 26, 1991

[54] PAPERMAKING FABRIC HAVING RECESSES ON PAPERMAKING SURFACE FILLED WITH AUXILIARY WEFTS

[75] Inventors: Takuo Tate; Taketoshi Watanabe; Hiroyuki Nagura, all of Tokyo, Japan

[73] Assignee: Nippon Filcon Co., Ltd., Tokyo, Japan

[21] Appl. No.: 399,235

[22] Filed: Aug. 29, 1989

[30] Foreign Application Priority Data

Aug. 31, 1988 [JP] Japan ..... 63-215022

[51] Int. Cl.[5] ..... D03D 13/00

[52] U.S. Cl. ..... 139/383 A

[58] Field of Search ..... 162/DIG. 1, 348, 358; 428/257; 139/383 A, 425 A

[56] References Cited

U.S. PATENT DOCUMENTS

| | | | |
|---|---|---|---|
| 4,076,627 | 2/1978 | Friedrichs | 139/425 A X |
| 4,157,276 | 6/1979 | Wandel et al. | 139/425 A X |
| 4,281,688 | 8/1981 | Kelly et al. | 139/425 A X |
| 4,423,755 | 1/1984 | Thompson | 139/425 A X |

*Primary Examiner*—Andrew M. Falik

*Attorney, Agent, or Firm*—Beveridge, DeGrandi & Weilacher

[57] ABSTRACT

In a single-layer papermaking woven fabric or more than three shafts having an extended running surface formed from long crimped primary wefts, auxiliary wefts each having a smaller diameter than that of primary wefts are each disposed between each of primary wefts. Every auxiliary weft is placed on warps at portions extended from the paper side of where warps are primary weft to the running said of the succeeding primary weft or at portions where warps are extended from the running side of a primary weft to the paper side of the succeeding primary weft. Each of said auxiliary wefts is woven into texture of the fabric at least once in a repeating unit by a warp to thereby complete the repeating unit. To this end, the auxiliary wefts are disposed in recesses which will otherwise make appearance on said papermaking surface at locations corresponding to the portions of the warps extending from one of the papermaking surface and the running surface of the fabric toward the other in order thereby to form a smooth papermaking surface.

7 Claims, 12 Drawing Sheets

PAPERMAKING FABRIC HAVING RECESSES ON PAPERMAKING SURFACE FILLED WITH AUXILIARY WEFTS

BACKGROUND OF THE INVENTION

The present invention relates to a papermaking fabric for use in the paper manufacture.

In the conventional papermaking process carried out by using a fourdrinier wire screen, a slurry of raw paper material is fed onto an endless papermaking woven fabric or cloth running continuously. The papermaking cloth separates cellulosic fibers from the slurry to thereby form a moist paper web thereon. From this viewpoint, it can be said that the papermaking cloth or woven fabric functions as a filter for forming the moist paper web. Mesh apertures of the fabric also referred to as the drain orifices serve for separating water from the slurry. Further, in the case of a fourdrinier machine the papermaking fabric serves also as a driving belt and is thus subjected to a tension exerted by the machine. In view of this, it is required that the papermaking fabric should exhibit an enhanced stability in respect to the attitude.

Among the several requirements imposed on the papermaking process, the following are to be mentioned among others in connection with the papermaking fabric. Namely, the papermaking fabric is required to exhibit a high retention capability for the minimum flow loss, no generation or formation of wire marks, a high drainage capability with a reduced water containing capacity, a high capability of abrasion resistance, and enhanced running stability.

With a view to satisfying the above requirements imposed on the papermaking woven fabric, there have heretofore been made a variety of proposals. However, at the present state of the art, there are yet unavailable the papermaking woven fabrics which satisfy the abovementioned requirements to the satisfactory extent.

By way of example, the papermaking fabric woven finely by using fine yarns in an effort to enhance the raw paper material retention capability while preventing formation of the wire marks suffers from such shortcomings that the runability and the abrasion resistance capability were poor. In recent years, attempts have been made to form the papermaking surface of the fabric from the wefts for thereby improving the paper material retention capability. The papermaking surface formed from the wefts is certainly advantageous in that the woven fabric is improved in respect to the drainage property because of little or no possibility of the drain apertures formed between the warps being directly blocked by the raw paper material. In that case, it is however noted that the wire marks become more noticeable because the inter-weft gaps are increased correspondingly.

As an approach to solve the above problem, it has been proposed to increase the number of the wefts forming the papermaking surface by disposing so-called floating yarns which are not usually woven into the texture of the fabric in the form of interweave with the warps and the wefts. This proposal is certainly an interesting technical idea from the standpoint of increasing the number of the wefts of the papermaking surface of the fabric, which idea cannot however be applied to practical papermaking process. The reason for this is that the wefts not woven into the texture, i.e. the floating yarns tend to be moved and collected together under a hydraulic pressure applied thereto upon charging of the slurry on the papermaking fabric, resulting in that the papermaking surface cannot be maintained horizontally flat or smoothly.

The problem of formation of the wire marks becomes more noticeable in the case of the single-layer woven fabric in which the wefts form projections on the papermaking surface.

There has also been proposed the use of a multi-layer woven fabric in an effort to realize a high drainage property and a papermaking surface of a fine mesh while ensuring a high abrasion resistance capability.

Recently, there has arisen a trend that the papermaking process be carried out at a higher speed with a view to increasing the efficiency of paper manufacture process, which however presents additional new problems. The multi-layer woven fabric which can certainly exhibit advantageous effects unattainable with the single-layer woven fabric has a high water retaining property which is primarily ascribable to the multi-layer structure. By way of example, when the endless screen formed of the multi-layer woven fabric is driven at a high speed, there will take place such a phenomenon that water droplets are caused to fly out particularly at positions of the rotating turn-back rolls under a centrifugal force.

In this conjunction, it is noted that the single-layer woven fabric is substantially insusceptible to the phenomenon mentioned above due to inherently small water retention capacity. However, the single-layer woven fabric is conventionally provided with long knuckles disposed over the running surface for ensuring the abrasion resistance capability. Consequently, the papermaking surface assumes such a configuration that the long knuckles of warps are disposed in parallel with the knuckles of the weft projecting therebetween. When the raw paper material slurry is supplied onto the papermaking fabric or clothing in the course of running thereof, the paper fibers are necessarily oriented in the running or machine direction to be deposited between the long knuckles of the warps disposed in parallel on the cloth or caused to displace downwardly. The deposition or accumulation of the fibers between the parallel long knuckles of the warps will necessarily block the flow paths through which water can be drained, resulting in an obstacle to the desired drainage. In order to avoid this difficulty, the vacuum must be increased, which will however favor the appearance of the wire marks.

In the course of intensive studies conducted by the inventor of the present application in tackling the solution of the problems associated with the requirements for a high paper material retention capability, suppression of generation of the wire marks, a high water drainage capability and a low water containing capacity, a high abrasion resistance capability and an improved runability and others, it has been found that an increased density of the wefts in the papermaking surface of the fabric is not suited for improving the raw paper material retention capability, while the multi-layer woven fabric is subjected to a limitation in reducing the water retention capacity of the fabric, requiring thus the use of the single-layer woven fabric, and that not only the plain weave but also the twill weave and satin weave of the single-layer fabric cannot reduce the void volume formed by the warps, being ineffective in preventing the formation of the pulp mats between the warps.

SUMMARY OF THE INVENTION

In view of the state of the art described above, the present invention provides a single-layer papermaking woven fabric of more than three shafts inclusive thereof having an extended running surface formed from long crimped wefts, wherein auxiliary wefts each having a smaller diameter than that of the weft are each disposed, respectively, between adjacent ones of the wefts on warps at portions thereof extending from the top side of preceding one of the adjacent wefts to the bottom side of the succeeding weft or at portions of the warps extending from the bottom side of the preceding one of the adjacent wefts to the top side of the succeeding weft, each of the auxiliary wefts being woven into texture of the woven fabric at least once by a warp to thereby complete a unity texture, whereby the auxiliary wefts are disposed in recesses which will otherwise make appearance on the papermaking surface at locations corresponding to the portions of the warps extending from one of the papermaking surface and the running surface toward the other to thereby form smoothly the papermaking surface.

According to a preferred aspect of the invention, a plurality of auxiliary wefts are disposed between the adjacent wefts, respectively.

In the single-layer woven fabrics according to the invention, each auxiliary weft is positions between two adjacent wefts and disposed in the recesses which will otherwise be formed at the positions where the warps extend from the top side of the preceding weft to the succeeding one as well as at the positions where the warps extend from the bottom side of the preceding weft to the tops side of the succeeding weft, i.e. the recesses otherwise formed in the papermaking surface between the wefts upon every transition of the individual warps in the running direction from one of the papermaking surface and the running surface of the fabric toward the other, to thereby form the smooth and flat papermaking surface. Described in some detail in conjunction with the portions of the warps on which the auxiliary wefts are disposed, although the auxiliary wefts are disposed between the adjacent wefts, respectively, on the warps at the positions thereof where the warps extend from one of the papermaking surface and the running surface toward the other as described above, it should be understood that the abovementioned positions may include such a location where one of two adjacent warps disposed between the adjacent wefts extends from the top side of the preceding weft to the bottom side of the succeeding weft with the other warp extending from the bottom side of the preceding weft to the top side of the succeeding weft and the location where one of the two warps disposed to sandwich therebetween another warp on the running surface of the fabric extends from the top side of the preceding weft toward the bottom side of the succeeding weft while the other one of the abovementioned two warps extends from the bottom side of the preceding weft to the top side of the succeeding weft, as will be made more apparent as the description proceeds.

Since each auxiliary weft is woven into the texture of the fabric at least once, there are formed a number of knuckles of the auxiliary wefts in the papermaking surface of the fabric. Thus, the papermaking surface of the woven fabric according to the present invention is characterized in that the papermaking surface is composed mainly of the auxiliary wefts of a small diameter and the inherent wefts, whereby the papermaking surface enriched in the weft is realized.

The woven fabric according to the invention can be made from polyamide yarns or polyester yarns. The auxiliary wefts should preferably be made of polyester or polyamide yarns. The auxiliary wefts are each disposed between the adjacent ones of the inherent wefts. In this connection, it should be disposed between the adjacent wefts so far as the fabric consists of the single-layer woven fabric.

As the basic texture or structure of the woven fabric or cloth in which the auxiliary wefts are to be incorporated according to the teaching of the present invention, there may be mentioned 3/1 broken satin, 4/1 satin, 3/1 to 4/1 twill weave, 2/2 twill weave and the like. In the case of the 2/1 twill woven fabric, the invention can also be applied to a 6-shaft texture.

Since the woven fabric according to the invention is of more than three shafts inclusive thereof, the wefts forming the running surface form the long crimps to thereby improve the abrasion resistance capability, to further advantage.

Figure 1:
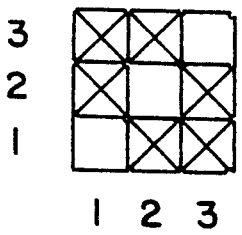
PRIOR ART FIG.1
FIG. 1, FIG. 5, FIG. 10, FIG. 14, FIG. 18, FIG. 20, FIG. 24 and FIG. 28 show textile design charts of the basic units forming the papermaking fabric according to the prior art.

In the drawings, Arabic numerals denote warps and wefts, Arabic numerals with prime "'" denote auxiliary wefts, and A to F represent the wefts in cross sections, respectively.

DETAILED DESCRIPTION OF THE PREFERRED EMBODIMENTS

In the following, exemplary or preferred embodiments of the present invention will be described in more detail by referring to the accompanying drawings which show in textile design charts textures or structures of woven fabrics. For convenience of explanation, typical structures of basic textiles of three to five shafts in which the auxiliary wefts are incorporated will be described by referring to FIG. 1, FIG. 5, FIG. 10, FIG. 14, FIG. 18, FIG. 20, FIG. 24 and FIG. 28. It should however be understood that the present invention can also be applied to the fabrics of other than the abovementioned shaft numbers. In other words, the present invention can find its application equally to the papermaking cloth of eight to ten shafts.

In each of the unity textile design charts shown in the drawings, the warps and the inherent wefts are designated by Arabic numerals such as, for example, 1, 2, 3 and so forth, while the auxiliary wefts are denoted by Arabic numerals with prime "′" such as, for example, 1′, 2′, 3′, etc. Similarly, individual wefts shown in the basic texture charts are designated by Arabic numerals without the prime "′" in the unity textile design charts which illustrate the exemplary embodiments of the present invention, respectively. Additionally, throughout several drawings, a symbol "X" indicates the position where the warp is located on the weft as well as the position where the weft is woven into the texture by the warp. Besides, the symbol "X" shown above the auxiliary weft indicates the position at which the auxiliary weft is woven into the texture by the warp. A blank box having no mark "X" indicates a concave portion or recess formed by the warp extending from the top side of a given weft to the bottom side of a succeeding one or from the bottom side of a given weft to the top side of a succeeding one. As can be seen in the textile design charts, each of the concave portions or recesses is filled with the auxiliary weft according to the teaching of the invention.

Now, referring to the drawings, FIG. 1 shows one unity texture of 2/1 twill woven fabric of 3 shafts as prior art.

Figure 2:
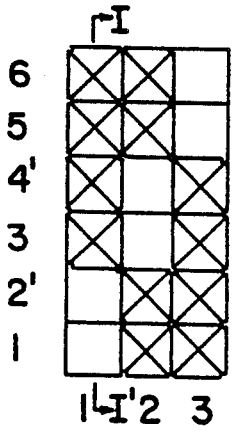
FIGS. 2 to 4, FIG. 6A, FIGS. 7 to 9, FIGS. 11A, 12 and 13A, FIGS. 15 to 17, FIG. 19, FIGS. 21, 22A and 23, FIGS. 25A, 26 and 27 and FIG. 29 show textile design charts of the exemplary unit embodiments of the present invention.

FIG. 2 shows a woven fabric according to an embodiment of the present invention. Referring to the figure, the woven fabric is constituted by 3-shaft 2/1 twill woven cloth in which the auxiliary wefts 2′, 4′ and 6′ are disposed sequentially one by one between the adjacent wefts 1, 2 and 3 shown in FIG. 1, respectively, wherein the weft 1 shown in FIG. 2 corresponds to the weft 1 shown in FIG. 2, which the weft 2 shown in FIG. 1 corresponds to the weft 3 shown in FIG. 2 with the weft 3 shown in FIG. 1 corresponding to the weft 5 shown in FIG. 2. Considering the auxiliary weft 2′, by way of example, this auxiliary weft 2′ is positioned between the wefts 1 and 3 and woven twice into the texture by the warps 2 and 3 to thereby fill the concave portion or recess which will otherwise be formed in a papermaking surface by the warp 1 at the portion thereof extending from the bottom side of the weft 1 to the top side of the weft 3, i.e. extending from the running surface to the papermaking surface of the fabric and located at the position indicated by the blank portion of the auxiliary weft 2′ not labeled with the symbol "X" in FIG. 2. In this manner, in each of the unity textile design charts illustrating the exemplary embodiments of the present invention, those concave portions or recesses located at the positions indicted by the rectangular blank areas, respectively, and each formed by the warp extending from one of the papermaking surface and the running surface of the woven fabric to the other are filled with the auxiliary wefts, respectively, whereby the papermaking surface is realized substantially flat or even with the wire marks being prevented from making appearance.

Figure 3:
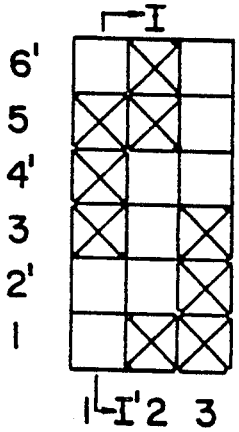

FIG. 3 shows another embodiment of the present invention according to which the auxiliary wefts 2′, 4′ and 6′ are disposed one by one between the individual wefts 1, 2 and 3 in a 3-shaft 2/1 twill woven fabric shown in FIG. 1. The embodiment shown in FIG. 3 differs from that shown in FIG. 2 in respect to the position at which the auxiliary wefts are woven into the texture by the warps. More specifically, referring to the textile design chart shown in FIG. 3, the weft 1 corresponds to the weft 1 shown in FIG. 1, the weft 3 corresponds to the weft 2 shown in FIG. 1 and the weft 5 corresponds to the weft 3 shown in FIG. 1.

Considering by taking as example the auxiliary weft 2′, this auxiliary weft 2′ is disposed between the wefts 1 and 3 and woven once into the texture by the warp 3 and fill the recesses formed, respectively, by the portion of the warp 1 extending from the bottom side of the weft 1 to the top side of the weft 3 and the portion of the warp 2 extending from the top side of the weft 1 to the bottom side of the weft 2, i.e. the recesses formed in the papermaking surface of the woven fabric at locations at which the warps 1 and 2 transit from one of the running surface and the papermaking surface of the fabric to the other, wherein the recesses are shown in FIG. 3 by the rectangular blank areas of the auxiliary weft 2′ not marked by the symbol "X".

In this manner, the papermaking surface of the woven fabric according to the above embodiment of the invention can be finished flat while being protected from the formation of the wire marks.

Figure 4:
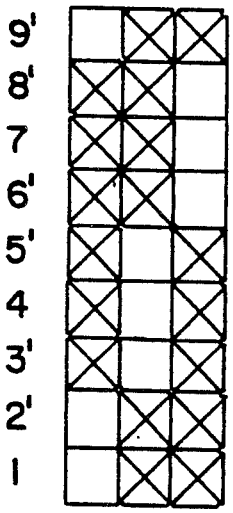

FIG. 4 shows another embodiment of the present invention in which a pair of the auxiliary wefts are disposed between the adjacent wefts, respectively. Paying attention to the auxiliary weft 2′ by way of example, this auxiliary weft 2′ is woven twice into the unity texture by the warps 2 and 3 and fills the recesses otherwise formed in the papermaking surface at a location where the warp 1 extends from the bottom side of the weft 1 to the top side of the weft 4, i.e. the recess formed in the papermaking surface of the woven fabric upon transition of the warp 1 from the running surface to the papermaking surface. The recess is indicated by the rectangular blank area of the auxiliary weft 2′ in FIG. 4 as well. Similarly, the auxiliary weft 3′ is woven twice into the unity texture by the warps 1 and 3 and fills the recess overlying the warp 2 at the location where the warp 2 extends from the top side of the weft 1 to the bottom side of the weft 4, i.e. the recess formed in the papermaking surface upon transition of the warp 2 in the running direction from the papermaking surface of the woven fabric toward the running surface thereof. The concave recess is also indicated by the rectangular blank area without the mark "X" of the auxiliary weft 3′.

The papermaking surface of the woven fabric is thus made flat by virtue of the presence of the auxiliary wefts, whereby formation of the wire marks is prevented.

Figure 5:
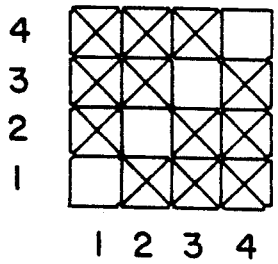
PRIOR ART FIG. 5

FIG. 5 shows a unity texture of 4-shart 3/1 twill woven fabric as prior art.

Figure 6A:
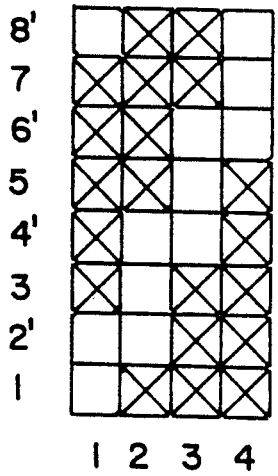
Figure 6B:
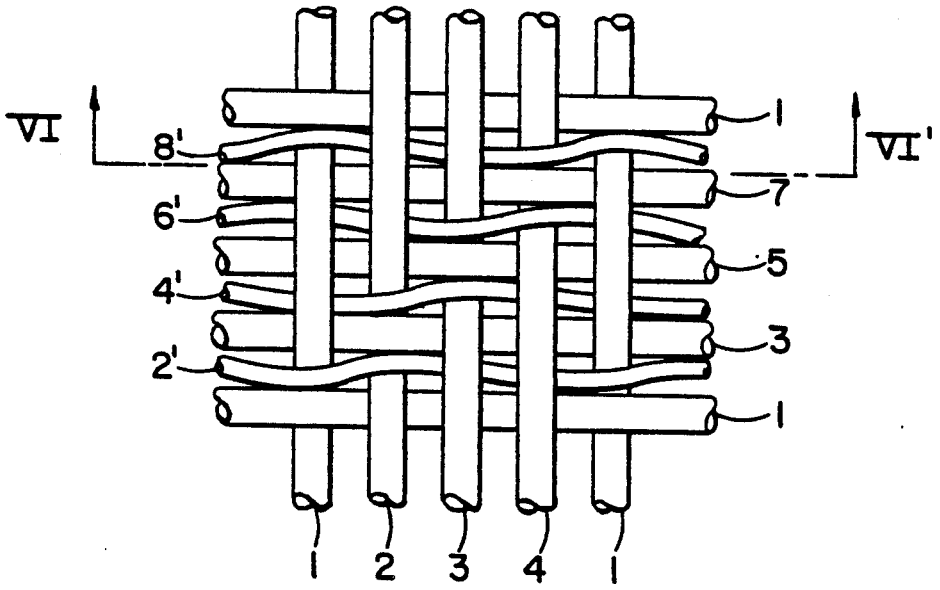
FIG. 6B, FIG. 11B, FIG. 13B, FIG. 22B and FIG. 25B show plan view of the woven fabrics shown in FIG. 6A, FIG. 11A, FIG. 13A, FIG. 22A and FIG. 25A respectively.
Figure 6C:
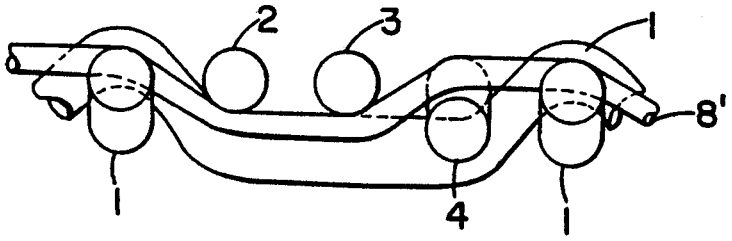
FIG. 6C, FIG. 11C, FIG. 13C, FIG. 22C and FIG. 25C show cross-sectional views of the woven fabric shown in FIG. 6B, FIG. 11B, FIG. 13B, FIG. 22B and FIG. 25B taken along the lines VI—VI', XI—XI', XIII—XIII', XXII—XXII' and XXV—XXV' respectively.

FIGS. 6A, 6B and 6C show a further embodiment of the present invention according to which the auxiliary weft is disposed one by one between the adjacent wefts, respectively, in the woven fabric shown in FIG. 5. FIG. 6B is a plan view of the woven fabric shown in FIG. 6A, and FIG. 6C shows a cross-sectional view of the fabric shown in FIG. 6B taken along the line VI—VI′. The auxiliary wefts are denoted by the reference numerals 2′, 4′, 6′ and 8′. Considering the auxiliary weft 2′, it will be seen that the auxiliary weft 2′ is woven twice into the unity texture by the warps 3 and 4 and fills the recesses otherwise formed on the warp 1 at the location where it extends from the bottom side of the weft 1 to the top side of the weft 3 and the recess otherwise formed on the warp 2 at the location where the warp 2 extends from the top side of the weft 1 to the bottom side of the weft 3, i.e. the two recesses otherwise formed in the papermaking surface of the woven fabric upon transitions of the warps 1 and 2 from one of the running surface and the papermaking surface of the fabric to the other and indicated by two blank areas without the mark "X" of auxiliary weft 2' shown in FIG. 6A. According to this embodiment, the papermaking surface of the woven fabric is finished flat by virtue of the presence of the auxiliary wefts and protected from formation of the wire marks.

Figure 7:
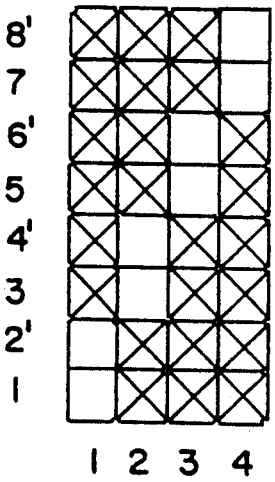
Figure 8:
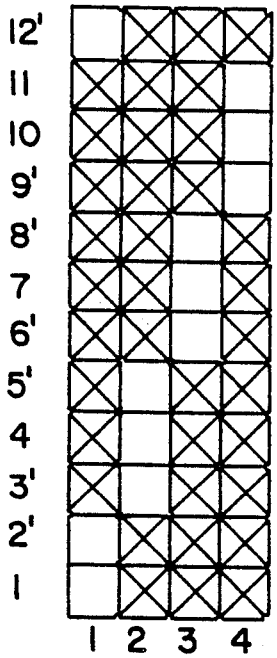

FIG. 7 shows still another embodiment of the present invention which is similar to the one shown in FIG. 6 in that the auxiliary wefts are disposed one by one between the adjacent wefts but differs from the latter in respect to the position at which the auxiliary weft is woven into the texture. Describing the embodiment shown in FIG. 7 by paying attention to the auxiliary weft 2', only by way of example, this auxiliary weft 2', only by way of example, this auxiliary weft 2' is woven thrice into the unity texture by the warps 2, 3 and 4 and fills the recess which will otherwise be formed above the portion of the warp 1 located at the position where the warp 1 extends from the bottom side of the weft 1 toward the top side of the weft 3, i.e. the recess otherwise formed in the papermaking surface of the woven fabric at the position corresponding to the transition of the warp 1 from the running surface of the fabric to the papermaking surface and indicated by the blank area not marked by the symbol "X" on the auxiliary weft 2' in FIG. 7, to thereby form the flat papermaking surface of the woven fabric. In other words, although the auxiliary weft 2' is woven twice into the texture by the warps 3 and 4 in the case of the embodiment shown in FIG. 6, the auxiliary weft 2' is woven three times into the texture by the warps 2, 3 and 4 according to the instant embodiment shown in FIG. 7. FIG. 8 shows a still further embodiment of the invention in which pairs of the auxiliary wefts 2'; 3', 5'; 6', 8'; 9' and 11'; 12' are provided between the adjacent wefts 1, 2, 3 and 4 of the woven fabric shown in FIG. 5. Referring to FIG. 8, the auxiliary weft 2' is woven three times into the texture by the warps 2, 3 and 4, respeCtively, and fills the recess otherwise formed at the position where the warp 1 extends from the bottom side of the weft 1 toward the top side of the weft 4, i.e. the recess otherwise formed in the papermaking surface of the woven fabric at the position corresponding to the transition of the warp 1 from the running surface of the fabric to the papermaking surface thereof and indicated by the blank area without the mark "X" in FIG. 8, to thereby finish flat the papermaking surface of the woven fabric. On the other hand, the auxiliary weft 3' is woven three times into the texture by the warps 1, 3 and 4 and fills the recess otherwise formed overlying the portion of the warp 2 extending from the top side of the weft 1 to the bottom side of the weft 4, i.e. the recess otherwise formed in the papermaking surface of the woven fabric upon transition of the warp 2 from the papermaking surface of the fabric toward the running surface thereof and indicated by the blank area not marked with "X" in FIG. 8, to thereby form flat the papermaking surface of the woven fabric.

With the structure of the cloth shown in FIG. 8, the papermaking surface thereof is finished flat and protected from formation of the wire marks.

Figure 9:
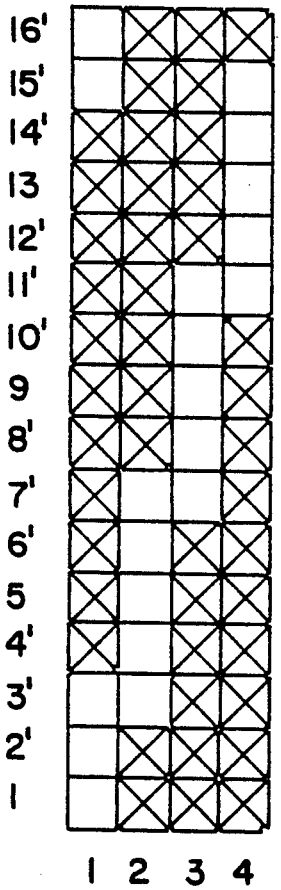

FIG. 9 shows a still further embodiment of the present invention in which triples of auxiliary wefts 2'; 3'; 4', 6'; 7'; 8',10'; 11'; 12' and 14'; 15'; 16' are disposed between the adjacent individual wefts 1, 2, 3 and 4 of the texture illustrated in FIG. 5. Referring to FIG. 9, the auxiliary weft 2' is woven three times into the texture by the warps 2, 3 and 4, respectively, and fills the recess otherwise formed above the portion of the warp 1 which extends from the bottom side of the weft 1 to the top side of the weft 5, i.e. the recess otherwise formed at the position corresPonding to the transition of the warp 1 from the running surface of the woven fabric to the papermaking surface thereof and indicated by the blank area of the auxiliary weft 2' not marked with "X" in FIG. 9, to thereby form the flat or smooth papermaking surface. On the other hand, the auxiliary weft 3' is woven twice into the texture by the warps 3 and 4, respectively, and fills two recesses otherwise formed above the portions of the warp 1 extending from the bottom side of the weft 1 to the top side of the weft 3 and the warp 2 extending from the top side of the weft 1 to the bottom side of the weft 5, i.e. the recesses otherwise formed at the two locations corresponding to the transitions of the warps 1 and 2 from one of the papermaking surface of the woven fabric and the running surface thereof toward the other and indicated by the blank areas not marked by "X" of the auxiliary weft 3' in FIG. 9, to thereby form the flat papermaking surface. Finally, the auxiliary weft 4' is woven three times into the fabric by the warps 1, 3 and 4, respectively, and fills the recess otherwise formed on the warp 2 at the location where the warp 2 extends from the papermaking surface of the fabric toward the running surface, i.e. the recess indicated by the blank area not marked with "X" of the auxiliary weft 4' in FIG. 9.

By virtue of the structure of the woven fabric described above, the papermaking surface is finished flat and protected from formation of the wire marks.

Figure 10:
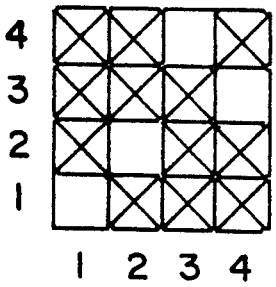
PRIOR ART FIG.10

FIG. 10 shows in a unity textile design chart a unity texture of 4-shaft 3/1 broken twill woven fabric as prior art.

Figure 11A:
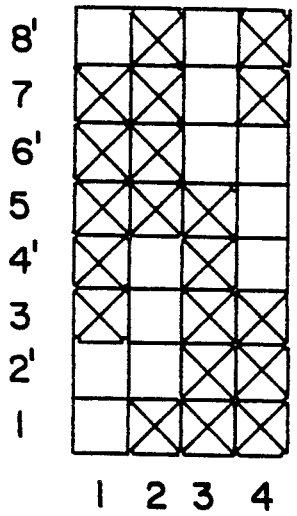
Figure 11B:
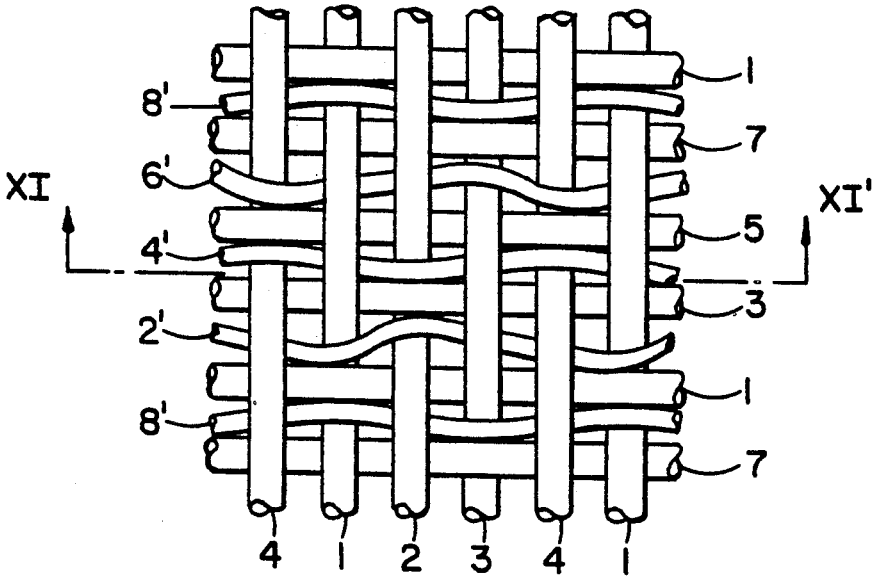
Figure 11C:
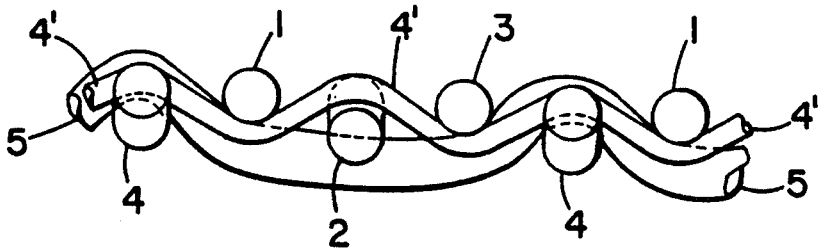

FIGS. 11A, 11B and 11C show a further embodiment of the present invention according to which the auxiliary wefts 2', 4', 6' and 8' are disposed one by one between the adjacent wefts 1, 2, 3 and 4, respectively, in the woven fabric shown in FIG. 10. FIG. 11B taken along the line II—II' to FIG. 11B shows a plan view of the woven fabric shown in FIG. 11A, and FIG. 11C shows a cross-sectional view of the fabric shown in FIG. 11B taken along the line XI—XI'. Considering this embodiment by paying attention to the auxiliary weft 2', it will be seen that the auxiliary weft 2' is woven twice into the texture by the warps 3 and 4 and fills the recess otherwise formed above the warp 1 at the portion where it extends from the bottom side of the weft 1 toward the top side of the weft 3 and the recess otherwise formed above the warp 2 at the portion where it extends from the top side of the weft 1 towards the bottom side of the weft 3, i.e. the two recesses otherwise formed in the papermaking surface of the woven fabric at the locations corresponding to transitions of the warps 1 and 2 from one of the running surface and the papermaking surface toward the other, respectively, and indicated by two blank areas without the mark "X" of the auxiliary weft 2' in FIG. 11A. According to this embodiment, the papermaking surface of the woven fabric is finished flat by virtue of the presence of the auxiliary wefts.

Figure 12:
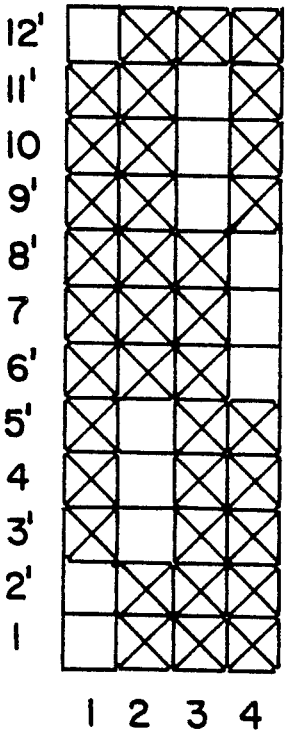

FIG. 12 shows another embodiment of the present invention in which pairs of the auxiliary wefts 2'; 3', 5'; 6', 8'; 9' and 11'; 12' are disposed between the adjacent wefts 1, 2, 3 and 4 of the woven fabric shown in FIG.

10. Describing the embodiment shown in FIG. 12 by paying attention to the auxiliary weft 2', this auxiliary weft 2' is woven three times into the texture by the warps 2, 3 and 4 and fills the recess otherwise formed above the portion of the warp 1 at which it extends from the bottom side of the weft 1 toward the top side of the weft 4, i.e. the recess otherwise formed in the papermaking surface of the woven fabric at the position corresponding to this transition of the warp 1 from the running surface of the fabric toward the papermaking surface and indicated by the blank area not marked by the symbol "X" of the auxiliary weft 2' in FIG. 12, to thereby form the flat papermaking surface of the woven fabric. Similarly, the auxiliary weft 3' is woven three times into the texture by the warps 1, 3 and 4 and fills the recess otherwise formed above the portion of the warp 2 extending from the top side of the weft 1 toward the bottom side of the weft 4, i.e. the recess otherwise formed in the papermaking surface of the woven fabric at the location corresponding to the transition of the warp 2 extending from the papermaking surface of the fabric toward the running surface thereof and indicated by the blank area not marked with "X", to thereby form flat the papermaking surface of the fabric.

In this manner, the recesses or concaves which would otherwise make appearance in the papermaking surface of the woven fabric are filled with the auxiliary wefts, whereby formation o the wire marks in the paper surface can be suppressed.

Figure 13A:
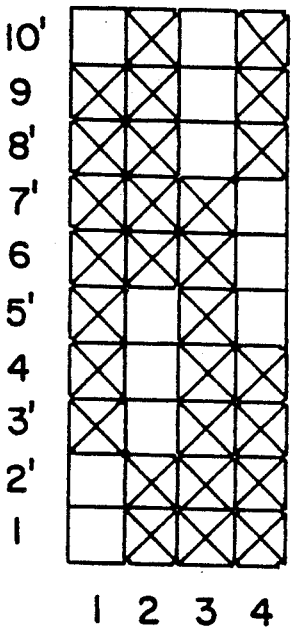
Figure 13B:
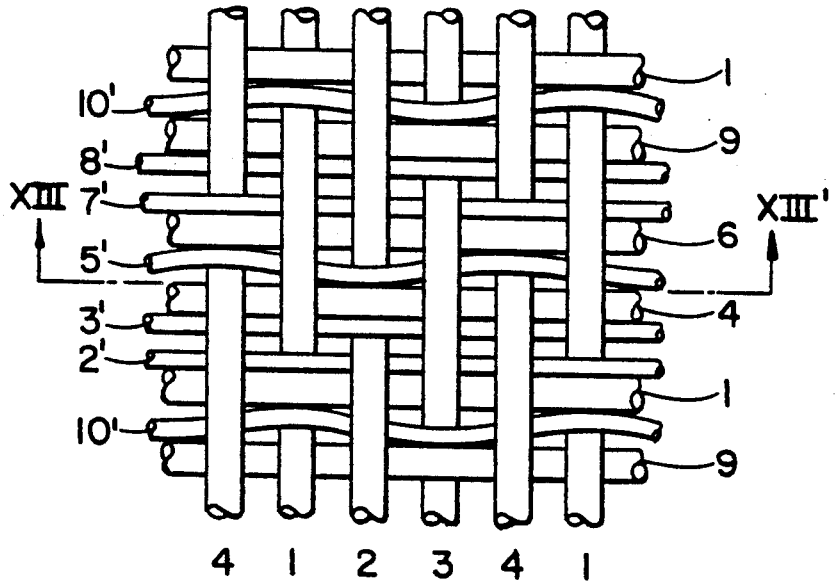
Figure 13C:
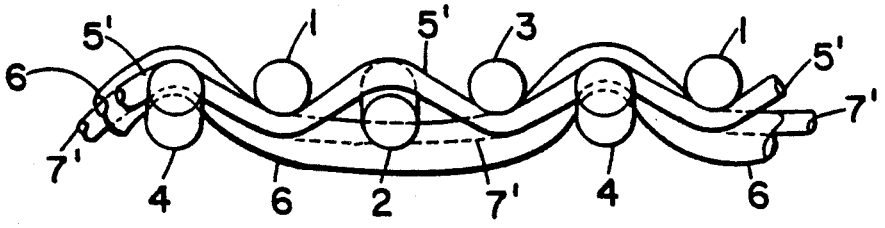

FIGS. 13A, 13B and 13C show still another embodiment of the present invention according to which paired auxiliary wefts 2' and 3', a single auxiliary weft 5', paired auxiliary wefts 7' and 8' and a single auxiliary weft 10' are disposed, respectively, between the adjacent wefts 1, 2, 3 and 4, respectively, in the woven fabric shown in FIG. 10. FIG. 13B shows a plan view of the woven fabric shown in FIG. 13A, and FIG. 13C shows a cross-sectional view of the fabric shown in FIG. 13B taken along the line XIII—XIII'. In other words single auxiliary weft and paired auxiliary wefts are alternately disposed. Paying attention to the auxiliary weft 2', for example, this auxiliary weft 2' is woven three times into the texture by the warps 2, 3 and 4 and fills the concave or recess formed above the top side of the warp 1 at the position where the warp 1 extends from the bottom side of the weft 1 to the top side of the weft 4, i.e. the recess formed in the papermaking surface at the position corresponding to the transition of the warp 1 from the running surface to the papermaking surface of the woven fabric and indicated by the rectangular blank area not marked by "X" of the auxiliary weft 2' in FIG. 13A. Similarly, the auxiliary weft 3' is woven three times into the texture by the warps 1, 3 and 4 and fills the recess overlying the warp 2 at the location where the warp 2 extends form the top side of the weft 1 to the bottom side of the weft 4, i.e. the recess formed in the papermaking surface at the Position corresponding to the transition of the warp 2 from the papermaking surface of the fabric toward the running surface thereof. The concave or recess is also indicated by the rectangular blank area without the mark "X on the auxiliary weft 3'. The papermaking surface of the woven fabric is thus made flat by the auxiliary wefts filling the concaves or recesses which would otherwise be formed, whereby formation of the wire marks is suppressed.

Figure 14:
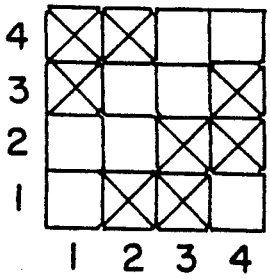
PRIOR ART FIG. 14

FIG. 14 shows in a unity textile design chart a unity texture of four-shaft 2/2 twill woven fabric as prior art.

Figure 15:
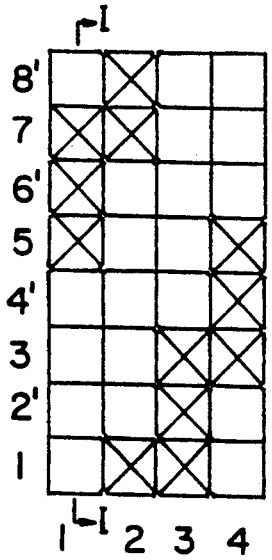

FIG. 15 shows a further embodiment of the present invention according to which the auxiliary weft is disposed one by one between the adjacent weft, respectively, in the woven fabric shown in FIG. 14. Considering the auxiliary weft 2', this auxiliary weft 2' is woven once into the texture by the warp 3 and fills the recess overlying the portion of the warp 1 extending from the bottom sides of the wefts 1 and 3 to the top side of the weft 5, the recess overlying the portion of warp 2 extending from the top side of the weft 1 toward the bottom side of the weft 3 and the recess overlying the portion of the warp 4 extending from the bottom side of the weft 1 to the top side of the weft 3, i.e. the recesses formed in the papermaking surface of the woven fabric at locations corresponding to transitions of the warps 1 and 4 in the direction from the running surface toward the papermaking surface and the transition of the warp 2 from the papermaking surface to the running surface and indicated by blank areas without the mark "X" of the auxiliary weft 2' in FIG. 15. On the other hand, the auxiliary weft 4' is woven once by the warp 4 and fills the concave or recess otherwise formed above the warp 1 at the location where it extends from the bottom sides of the wefts 1 and 3 to the top side of the weft 5, the recess otherwise formed above the warp 2 at the location where the warp 2 extends from the bottom sides of the wefts 1, 3 and 5 to the top side of the weft 7 and the recess otherwise formed above the warp 3 at the portion extending from the top side of the weft 3 to the bottom side of the weft 5, i.e. the recesses otherwise formed in the papermaking surface by the warps 1 and 3 sandwiching therebetween the warp 2 disposed on the running surface upon their transitions from one of the running surface to the papermaking surface incorporating the warp 2 disposed on the running surface, wherein the recesses are indicated by three blank areas without the mark "X" on the auxiliary weft 4' in FIG. 15. In this way, the papermaking surface of the woven fabric can be finished flat.

Figure 16:
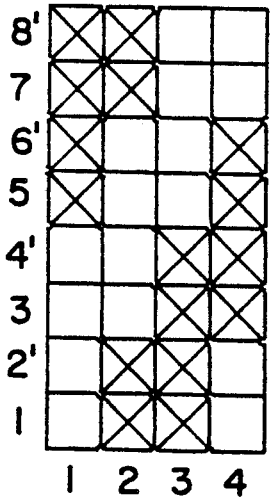

FIG. 16 shows yet another embodiment of the present invention according to which the auxiliary weft is disposed one by one between the adjacent weft, respectively, in the woven fabric shown in FIG. 14 and differs from the embodiment shown in FIG. 15 in that the auxiliary weft is woven into the texture twice rather than once. Considering this embodiment shown in FIG. 16 by paying attention to the auxiliary weft 2', it will be seen that the auxiliary weft 2' is woven twice by the warps 2 and 3 and fills the recess overlying the portion of the warp 1 extending from the bottom sides of the wefts 1 and 3 to the top side of the weft 5 and the recess overlying the portion of the warp 4 extending from the bottom side of the weft 1 toward the top side of weft 3, i.e. the two recesses otherwise formed in the papermaking surface of the woven fabric upon transitions of the warps 2 and 3 from one of the running surface and the papermaking surface of the fabric to the other and indicated by the blank areas without the mark "X" of the auxiliary weft 2' in FIG. 16. According to this embodiment, the papermaking surface of the woven fabric is finished flat by virtue of the presence of the auxiliary wefts.

Figure 17:
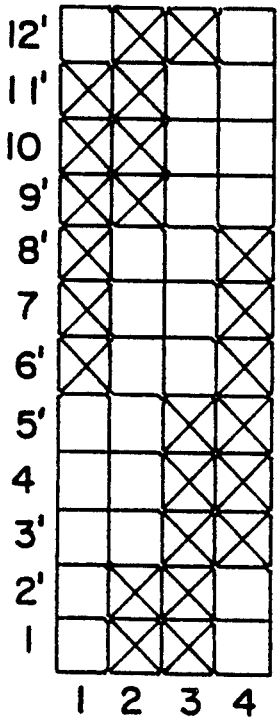

FIG. 17 shows a further exemplary embodiment of the present invention in which the auxiliary wefts are disposed in pairs between the adjacent wefts of the woven fabric shown in FIG. 14. Describing the embodiment by paying attention to the auxiliary weft 2', by way of example, this auxiliary weft 2' is woven into the texture by the warps 2 and 3 and fills the recess overlying the portion of the warp 1 which extends from the bottom sides of the wefts 1 and 4 toward the top side of the weft 7 and the recess overlying the portion of the warp 4 extending from the bottom side of the weft 1 to the top side of the weft 4, i.e. the recesses formed in the papermaking surface of the woven fabric at the positions corresponding to the transitions of the warps 1 and 4 from the running surface of the fabric to the papermaking surface and indicated by the blank area not marked by the symbol "X" on the auxiliary weft 2' in FIG. 1 to thereby form the flat papermaking surface. On the other hand, the auxiliary weft 3' is woven into the texture by the warps 3 and 4, respectively, and fills the recess overlying the portion of the warp 1 extending from the bottom sides of the wefts 1 and 4 to the top side of the weft 7 and the recess overlying the portion of the warp 2 extending from the top side of the weft 1 to the bottom side of the weft 4, i.e. the recesses otherwise formed at the locations corresponding to the transitions of the two warps 1 and 2 in from one of the papermaking surface and the running surface of the woven fabric to the other and indicated by the blank areas not marked by "X" of the auxiliary weft 3' in FIG. 17 to thereby form the flat papermaking surface.

In this manner, the papermaking surface of the woven fabric or cloth is formed flat by virtue of incorporation of the auxiliary wefts filling the recesses which would otherwise be formed and protected from formation of the wire marks.

Figure 18:
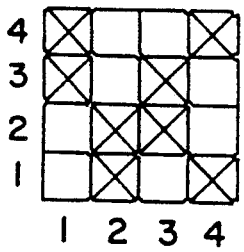
PRIOR ART FIG. 18

FIG. 18 shows in a unity textile design chart a unity texture of 4-shaft 2/2 broken twill woven fabric as prior art.

Figure 19:
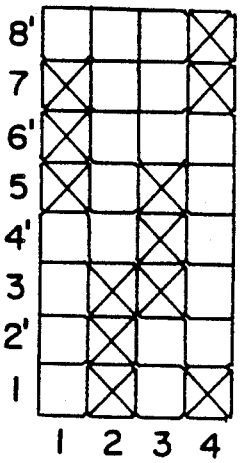

FIG. 19 shows a further embodiment of the present invention according to which the auxiliary wefts are disposed one by one between the adjacent wefts, respectively, in the woven fabric shown in FIG. 18. Considering the embodiment by paying attention to the auxiliary weft 2', this auxiliary weft 2' is woven once into the texture by the warp 2 and fills the recess otherwise formed on the warp 1 extending from the bottom sides of the wefts 1 and 3 to the top side of the weft 5, the recess otherwise formed above the warp 3 extending from the bottom side of the weft 1 toward the top side of the weft 3 and the recess otherwise formed on the warp 4 extending from the top side of the weft 1 toward the bottom side of the weft 3, i.e. the recesses otherwise formed in the papermaking surface of the woven fabric at locations corresponding to transitions of the warps 1, 3 and 4 from one of the running surface and the papermaking surface of the fabric to the other and indicated by blank areas without the mark "X" of auxiliary weft 2' in FIG. 19. According to this embodiment, the papermaking surface of the woven fabric is finished flat.

Figure 20:
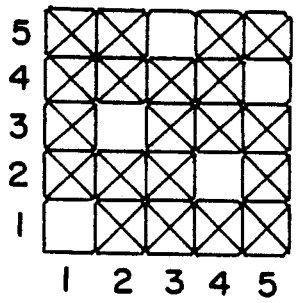

FIG. 20 shows in a unity textile design chart a unity texture of 5-shaft 4/1 satin woven fabric as prior art.

Figure 21:
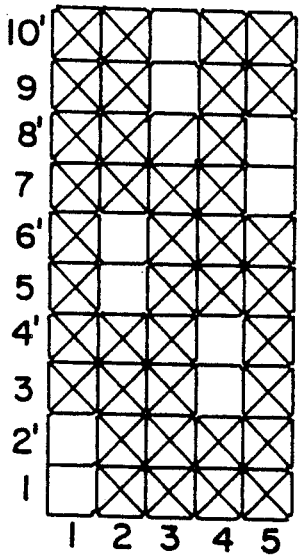

FIG. 21 shows yet another embodiment of the present invention in which one auxiliary weft is disposed between the adjacent wefts of the satin woven cloth shown in FIG. 20. Considering the auxiliary weft 2', this weft 2' is woven four times into the texture by the warps 2, 3, 4 and 5 to fill the concave portion or recess otherwise formed above the warp 1 extending from the bottom side of the weft 1 to the top side of the weft 3, i.e. the recess formed at the location corresponding to the transition of the warp 1 from the running surface of the fabric toward the papermaking surface and indicated by the blank area of the auxiliary weft 2' not labeled with the symbol "X", to thereby make flat the papermaking surface of the woven fabric.

Figure 22A:
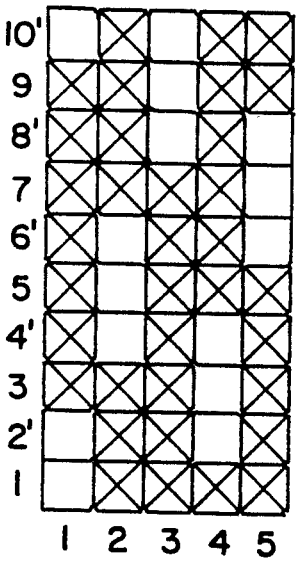
Figure 22B:
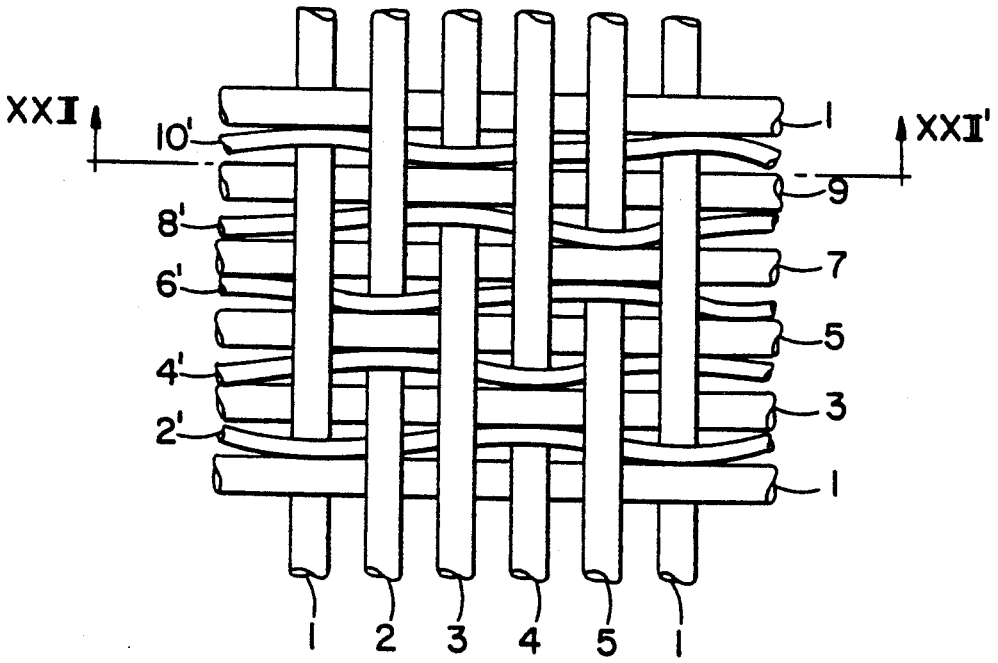
Figure 22C:
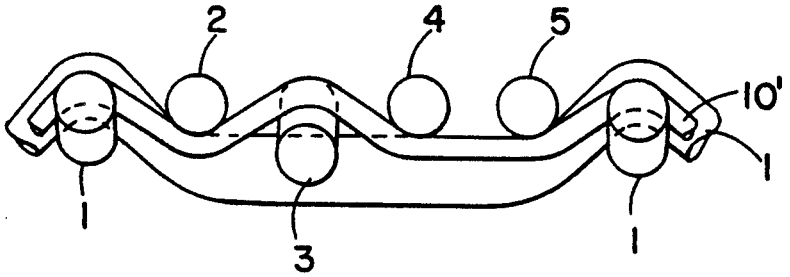

FIGS. 22A, 22B and 22C show a still further embodiment of the present invention which is similar to the one shown in FIG. 21 in that the auxiliary wefts are disposed one by one between the adjacent wefts but differs from the latter in respect to the position at which the auxiliary weft is woven into the texture. FIG. 22B shows a plan view of the woven fabric shown in FIG. 22A, and FIG. 22C shows a cross-sectional view of the fabric shown in FIG. 22B taken along the line XXII—XXII'. Describing the embodiment shown in FIGS. 22A, 22B and 22C by paying attention to the auxiliary weft 2', this auxiliary weft 2' is woven three times into the texture by the warps 2, 3 and 5 and fills the recess otherwise formed above the portion of the warp 1 extending from the bottom side of the weft 1 toward the top side of the weft 3 and the recess otherwise formed on the warp 4 extending from the top side of the weft 1 toward the bottom side of the weft 3, i.e. the recesses otherwise formed in the papermaking surface of the woven fabric at the positions corresponding to the transitions of the warps 1 and 4 from one of the running surface of the fabric and the papermaking surface of the fabric toward the other and indicated by the blank areas not marked by the symbol "X" of the auxiliary weft 2', to thereby form the flat papermaking surface of the woven fabric.

Figure 23:
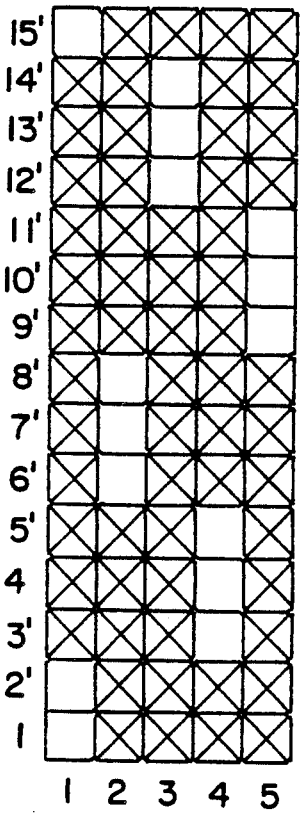

FIG. 23 shows still another embodiment of the present invention in which a pair of the auxiliary weft are disposed respectively between the adjacent wefts of the woven fabric shown in FIG. 20. Describing the instant embodiment by paying attention to the auxiliary weft 2', this auxiliary weft 2' is woven four times into the texture by the warps 2, 3, 4 and 5 and fills the recess otherwise formed above the portion of the warp 1 extending from the bottom side of the weft 1 toward the top side of the weft 4, i.e. the recesses otherwise formed in the papermaking surface of the woven fabric at the positions corresponding to the transitions of the warp 1 from the running surface of the fabric toward the papermaking surface and indicated by the blank area not marked by the symbol "X" of the auxiliary weft 2', to thereby form the flat papermaking surface of the woven fabric. On the other hand, the auxiliary weft 3' is woven four times into the texture by the wefts 1, 2, 3 and 5 to fill the recess otherwise formed above the portion of the warp 4 extending from the top side of the warp 1 toward the bottom side of the weft 4, i.e., the recess otherwise formed at the position corresponding to the transition of the warp 4 from the papermaking surface toward the running surface of the fabric and indicated by blank area without the mark "X" on the auxiliary weft 3', to thereby form the flat surface.

In this manner, the concaves or recesses which would otherwise be produced in the papermaking surface of the woven fabric are filled with the auxiliary wefts, whereby the flat papermaking surface suffering from no wire marks can be realized.

Figure 24:
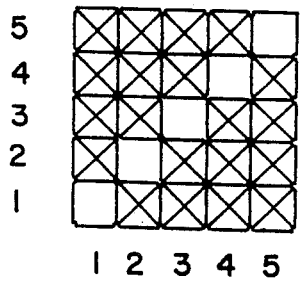
PRIOR ART FIG.24

FIG. 24 shows in a unity textile design chart a unity texture of 5-shaft 4/1 twill woven fabric as prior art.

Figure 25A:
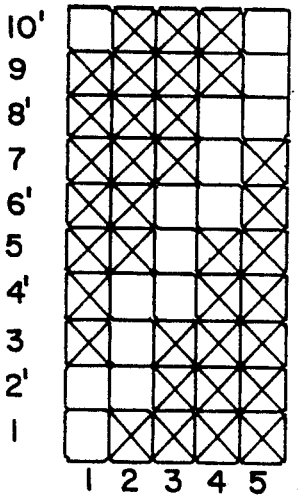
Figure 25B:
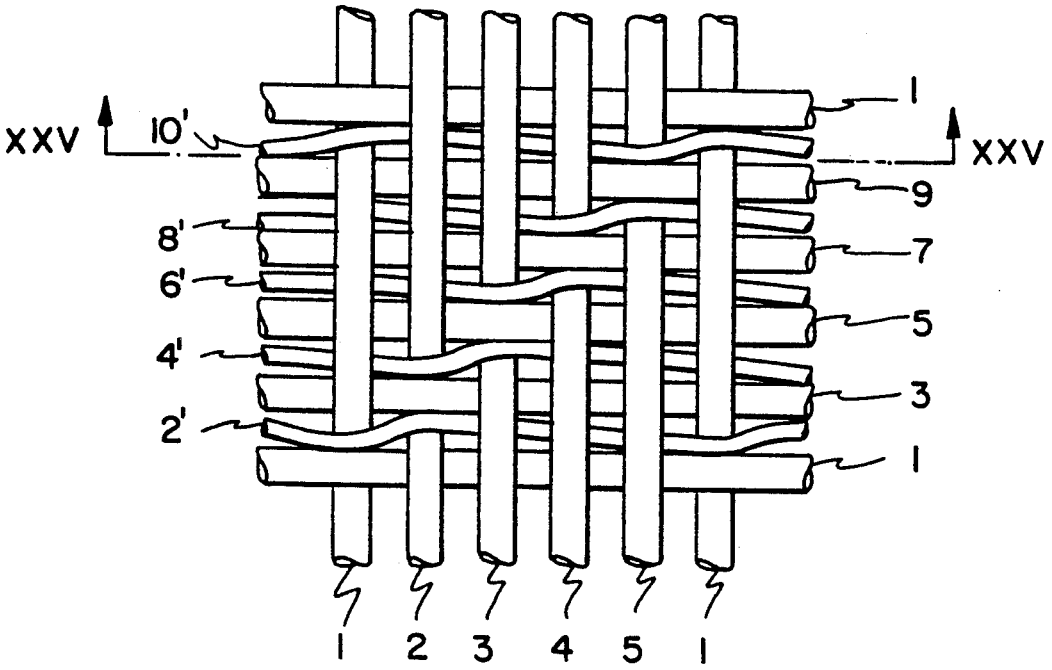
Figure 25C:
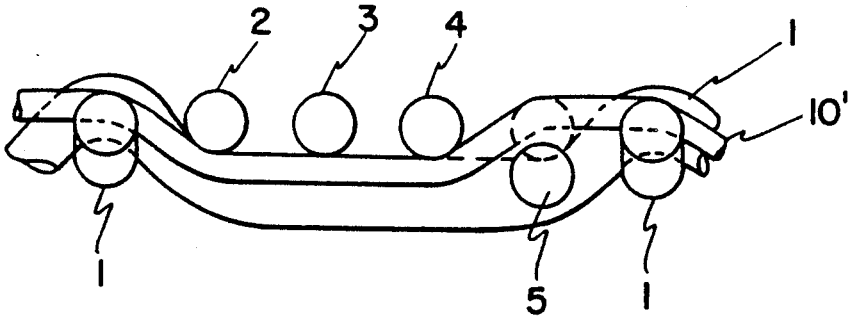

FIGS. 25A, 25B and 25C show an exemplary embodiment of the present invention in which the auxiliary wefts are each disposed between the adjacent wefts of the woven fabric shown in FIG. 24. FIG. 25B shows a plan view of the woven fabric shown in FIG. 25A, and FIG. 25C shows a cross-sectional view of the fabric woven in FIG. 25B taken along the line XXV—XXV'. Referring to FIGS. 25A, 25B and 25C, the auxiliary weft 2' is woven three times into the texture by the warps 3, 4 and 5, respectively, to thereby fill the recess overlying the portion of the warp 1 extending from the bottom side of the weft 1 toward the top side of the weft 3, and the recess overlying the warp 2 extending from the top side of the weft 1 to the bottom side of the weft 3, i.e. the recesses which would otherwise be formed in the papermaking surface of the woven fabric at the positions corresponding to the transitions of the warps 1 and 2 from one of the running surface of the fabric and the papermaking surface to the other and indicated by the blank areas without the mark "X", to thereby finish flat the papermaking surface of the woven fabric.

Figure 26:
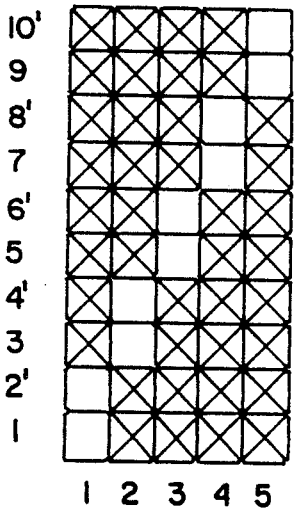

FIG. 26 shows yet another exemplary embodiment of the invention which differs from that shown in FIGS. 25A, 25B and 25C in respect to the position at which the weft is woven into the texture. Referring to FIG. 26, the auxiliary weft 2' is woven four times into the texture by the warps 2, 3, 4 and 5, respectively, and fills the recess otherwise formed above the portion of the warp 1 extending from the bottom side of the weft 1 to the top side of the weft 3, i.e. the recess located at the position corresponding to the transition of the warp from the running surface to the papermaking surface of the fabric and indicated by the blank area of the auxiliary weft 2' not marked with X', to thereby form the flat or smooth papermaking surface of the fabric.

Figure 27:
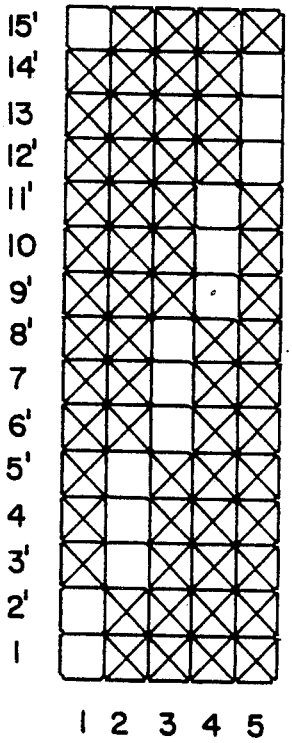

FIG. 27 shows a further embodiment of the invention in which parts of the auxiliary wefts are disposed between the adjacent wefts, respectively, in the woven fabric shown in FIG. 24. Referring to FIG. 27, the auxiliary weft 2' is woven four times into the texture by the warps 2, 3, 4 and 5, respectively, and fills the recess overlying the portion of the warp 1 extending from the bottom side of the weft 1 to the top side of the weft 4, i.e. the recess located at the position corresponding to the transition of the warp 1 from the running surface to the papermaking surface of the fabric and indicated by the blank area of the auxiliary weft 2' not marked with "X", to thereby finish flat the papermaking surface. Further, the auxiliary weft 3' is woven four times into the texture by the warps 1, 3, 4 and 5, respectively, and fills the recess overlying the portion of the warp 2 extending from the top side of the weft 1 to the bottom side of the weft 4, i.e. the recess otherwise formed at the location corresponding to the transition of the warp 2 from the papermaking surface toward the running surface of the fabric and indicated by the blank area not marked by "X" of the auxiliary weft 3' to thereby form the flat surface.

In this manner, the papermaking surface of the fabric or clothing is made flat due to the incorporation of the auxiliary wefts and protected against formation of the wire marks.

Figure 28:
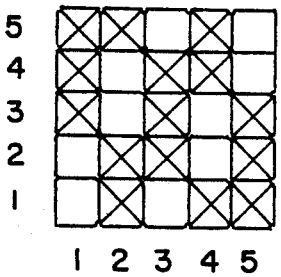
PRIOR ART FIG.28

FIG. 28 shows in a unity textile design chart a unity texture of 5-shaft 3/2 broken twill woven fabric as prior art.

Figure 29:
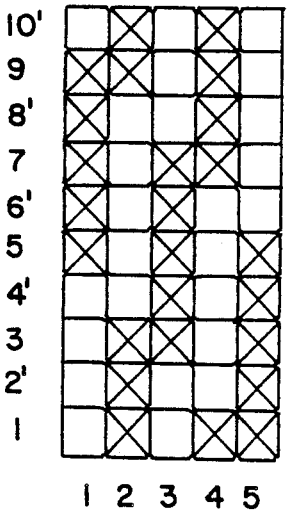

FIG. 29 shows a still further embodiment of the present invention in which the auxiliary wefts are each disposed between the adjacent wefts of the woven fabric shown in FIG. 28. Referring to FIG. 29, the auxiliary weft 2' is woven twice into the texture by the warps 2 and 5 and fills the recess otherwise formed above the portion of the warp 1 extending from the bottom sides of the weft 1 and 3 toward the top side of the weft 5, i.e. the recess otherwise formed above the portion of the warp 3 extending from the bottom side of the weft 1 to the top side of the weft 3 and the recess otherwise formed on the warp 4 extending from the top side of the weft 1 to the bottom side of the weft 3, i.e. the three recesses otherwise making appearance in the papermaking surface of the fabric at positions where the warps 1, 3 and 4 extend from one of the running surface and the papermaking surface to the other end indicated by the blank areas not marked with "X", to thereby form the flat papermaking surface of the fabric.

Figure 30:
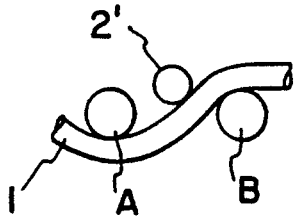
FIG. 30 is a vertical sectional view of the woven fabric shown in FIG. 2 taken along the line I—I'.

FIG. 30 is a vertical sectional view of the woven fabric shown in FIG. 2 taken along the warp 1 or line I—I'. In this figure, a reference numeral 1 denotes the warp 1 shown in FIG. 2, while A and B represent, respectively, the wefts 1 and 3 shown in cross section. It will be seen from this figure that the warp 1 extending from the bottom side of the weft A to the top side of the weft B forms a concave or recess in the papermaking surface of the woven fabric between the wefts A and B. The concave or the recess is filled with the auxiliary weft 2', whereby the flat surface is formed to serve as the papermaking surface.

Figure 31:
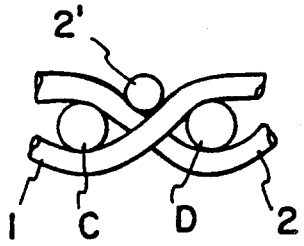
FIG. 31 is a vertical sectional view of the woven fabric shown in FIG. 3 taken along the line I—I'.

FIG. 31 is a vertical sectional view of the woven fabric shown in FIG. 3 taken along a weft 1 or the line I—I'. In this figure, numerals 1 and 2 denote the warps 1 and 2 shown in FIG. 3, while C and D represent the wefts 1 and 3 in cross section, respectively. As will be seen in this figure, the warp 1 extending from the bottom side of the weft C to the top side of the weft D and the warp 2 extending from the top side of the weft C to the bottom side of the weft D cooperate to form a recess in the papermaking surface of the woven fabric between the wefts C and D, which recess is however filled with the auxiliary weft 2' to thereby form the flat surface which is to serve as the papermaking surface.

Figure 32:
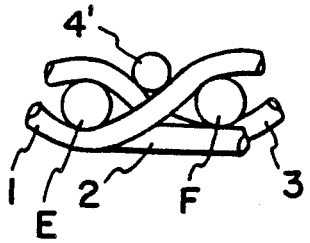
FIG. 32 is a vertical sectional view of the woven fabric shown in FIG. 15 taken along the line I—I'.

FIG. 32 is a vertical sectional view of the woven fabric shown in FIG. 15 and taken along a warp 1 or the line I—I'. In this figure, warps 1, 2 and 3 correspond to the warps 1, 2 and 3 shown in FIG. 15, respectively, while E and F represent the wefts 3 and 5 in cross section. It will be seen that the warp 2 extending underneath the wefts E and F is disposed between the warp 1 extending from the bottom side of the weft E to the top side of the weft F and the warp 3 extending from the top side of the weft E to the bottom side of the weft F. The three warps form a recess in the papermaking surface, which recess is however filled with an auxiliary weft 4' to make the papermaking surface flat or even.

In the conventional woven fabrics, formation of the recesses by the warps as mentioned above and hence the wire marks are invisible. According to the invention which teaches the disposition of the auxiliary wefts in the recesses formed in the papermaking surface or cloth for thereby filling the recesses, there can be realized a flat papermaking surface in the fabric with the formation of the wire marks being suppressed satisfactorily.

For demonstrating advantages effects brought about by the present invention, the woven fabrics manufactured according to the teaching of the invention were tested comparatively with the conventional fabrics, the results of which are shown below.

COMPARATIVE TEST 1

The results of the comparative test performed on the papermaking cloth shown in FIGS. 11A, 11B and 11C (exemplary embodiment 1) and the 3/1 satin woven cloth having the basic structure shown in FIG. 10 (fabric for comparison 1) are summarized in the following table 1.

TABLE 1

| | TEXTURE | EXEMPLARY EMBODIMENT 1 3/1 SATIN CLOTH + AUXILIARY WEFT | FABRIC FOR COMPARISON 1 3/1 SATIN CLOTH |
|---|---|---|---|
| STRUCTURE OF FABRIC | Warp material | PET monofilament | PET monofilament |
| | Diameter (mm) | 0.23 | 0.25 |
| | Density (number/inch) | 58 | 58 |
| | Weft material | PET monofilament | PET monofilament |
| | Diameter (mm) | 0.27 | 0.30 |
| | Density (number/inch) | 35 | 42 |
| | Auxiliary weft material | PA monofilament | |
| | Diameter (mm) | 0.15 | |
| | Density (number/inch) | 35 | |
| ITEMS OF TEST | Pulp slurry drainage time (sec.) | 5.8 | 6.2 |
| | Yield of pulp (%) | 78 | 66 |
| | Bekk smoothness (sec.) | 89 | 62 |

(Notes)
PET: polyester
PA: polyamide
pulp slurry drainage time: time taken by pulp slurry of 0.04% concentration containing 170 ml of freeness of defiberlized newspaper and having a water level of 300 mm until it is reduced to zero upon flowing down over fabric disposed with inclination of 15" relative to the vertical.

COMPARATIVE TEST 2

The results of the comparative test performed on the papermaking fabric shown in FIG. 15 (exemplary embodiment 2) and the 2/2 twill woven cloth having the basic structure shown in FIG. 14 (fabric for comparison 2) are summarized in the following table 2.

TABLE 2

| | TEXTURE | EXEMPLARY EMBODIMENT 2 2/2 TWILL WOVEN CLOTH + AUXILIARY WEFT | FABRIC FOR COMPARISON 2/2 TWILL CLOTH |
|---|---|---|---|
| STRUCTURE OF FABRIC | Warp material | PET monofilament | PET monofilament |
| | Diameter (mm) | 0.25 | 0.25 |
| | Density (number/inch) | 55 | 55 |
| | Weft material | PET/PA union monofilament (mixture weave) | PET monofilament |
| | Diameter (mm) | 0.30 | 0.32 |
| | Density (number/inch) | 35 | 38 |
| | Auxiliary weft material | PA monofilament | |
| | Diameter (mm) | 0.13 | |
| | Density (number/inch) | 35 | |
| ITEMS OF TEST | Pulp slurry drainage time (sec.) | 5.0 | 5.8 |
| | Yield of pulp (%) | 65 | 54 |
| | Bekk smoothness (sec.) | 63 | 49 |

As can be appreciated from the results of the test mentioned above, the papermaking cloth according to the present invention enjoys significantly advantageous effects over the prior art cloth with regards to the water drainage yield of pulp, Bekk smoothness and others.

When the fabric is observed in a section taken along a warp, it can be seen that every auxiliary weft is disposed in the recesses which will otherwise be formed in the papermaking surface of the fabric at locations where the warps extend from one of the papermaking surface and the running surface toward the other, to thereby fill the recesses and from the smooth papermaking surface. On the other hand, when viewed in a section taken along an auxiliary weft, it can be seen that the auxiliary weft is woven at least once in a repeating unit by the warp to thereby form a number of knuckles on the papermaking surface. As will be apparent from the foregoing, one of the important features of the present invention resides in that any one of the auxiliary wefts is woven at least once into the texture. By virtue of this feature, the auxiliary wefts constitute integral parts of the fabric texture and impart rigidity to the fabric to thereby enhance the runability of the fabric, to great advantage. Additionally, because the woven fabric is formed in the single-layer structure with voids as well as the water containing capacity being decreased, such phenomenon as water droplets spraying out from the fabric at a high speed of paper manufacture can be avoided, while the problem of generation of the wire marks due to piercing of pulp fibers through the inter-warp gaps to form the fiber mat can be solved satisfactorily, whereby drainage apertures of a size sufficient to improve the drainage through the papermaking fabric can be assured. Additionally, an increased density of the wefts on the papermaking surface of the woven fabric contributes to improvement of the fabric with regard to the paper material retention property while imparting an enhanced smoothness to the paper being manufactured.

The auxiliary weft employed according to the teaching of the present invention is required to have a smaller diameter than that of the inherent weft. By making smaller the diameter of the auxiliary weft, the thickness of the woven fabric and hence the voids of the woven fabric can be reduced correspondingly while ensuring a high drainage capability of the papermaking surface of the fabric.

In this way, the drawback of the multi-layer fabric in respect to the water containing capacity mentioned hereinbefore can be eliminated in a satisfactory manner. In this conjunction, it goes without saying that use of thick auxiliary weft having a large diameter gives rise to a problem that the water drainage property of the fabric is degraded because of blockage of the drainage apertures. This problem can also be solved successfully according to the present invention.

What is claimed is:

1. A single-layer papermaking woven fabric having a paper side and a running side formed of warps and primary and auxiliary wefts and having more than three shafts in a repeating unit, said running side formed from long crimped primary wefts, where, in said repeating unit, at least one auxiliary weft having a smaller diameter than that of said primary weft is disposed between two adjacent primary wefts and each primary weft is disposed between two adjacent auxiliary wefts, each of said warps extending on the paper side over at least two primary wefts and over at least two auxiliary wefts, where each repeating unit has at least one warp extending from the paper side over one of the said adjacent primary wefts to the running side of a second of said adjacent primary wefts, or has at least one warp extending from the running side of one of said adjacent primary wefts to the paper side of a second adjacent primary weft, each of said auxiliary wefts being woven into said fabric at least once by a warp to be over at least one warp and under at least one adjacent warp in said repeating unit, whereby said auxiliary wefts are disposed in recesses which will otherwise make appearance on said paper side at locations corresponding to the said warps extending from one of said paper side and said running side toward the other to thereby form a smooth paper side.

2. A single-layer papermaking woven fabric as set forth in claim 6, wherein each of said auxiliary wefts is disposed between adjacent primary wefts over two warps at those portions thereof where one of said two warps extends from the paper side of the preceding primary weft toward the running side of the succeeding primary weft and where the other of said two warps extends from the running side of the preceding primary weft to the paper side of the succeeding primary weft, respectively.

3. A single-layer papermaking woven fabric as set forth in claim 6 wherein each of said auxiliary wefts is disposed over three warps one of which is so disposed as to be sandwiched between the other warps on said running side at those portions where one of said other two warps extends from the paper side of the preceding primary weft toward the running side of the succeeding primary weft and where the other warp extends from the running side of the preceding primary weft toward the paper side of the succeeding primary weft.

4. A single-layer papermaking woven fabric as set forth in claim 6, wherein said auxiliary wefts are disposed one by one between the adjacent primary wefts, respectively.

5. A single-layer papermaking woven fabric as set forth in claim 6, wherein a plurality of auxiliary wefts are disposed between the adjacent primary wefts, respectfully.

6. The single-layer papermaking woven fabric according to claim 1, wherein, in each repeating unit, the number of warps disposed over the auxiliary weft is equal to or larger than the number of warps disposed under the auxiliary weft.

7. The single-layer papermaking woven fabric according to claim 1 wherein, in each repeating unit, the auxiliary weft is disposed in the running side for at least 50% of its length in each repeating unit.

* * * * *